US008881803B1

(12) United States Patent
Frost

(10) Patent No.: US 8,881,803 B1
(45) Date of Patent: Nov. 11, 2014

(54) DESANDER SYSTEM

(71) Applicant: Cavin B. Frost, Odessa, TX (US)

(72) Inventor: Cavin B. Frost, Odessa, TX (US)

( * ) Notice: Subject to any disclaimer, the term of this patent is extended or adjusted under 35 U.S.C. 154(b) by 0 days.

(21) Appl. No.: 14/284,200

(22) Filed: May 21, 2014

(51) Int. Cl.
*E21B 43/00* (2006.01)
*E21B 43/34* (2006.01)

(52) U.S. Cl.
CPC ..... *E21B 43/34* (2013.01)
USPC ..... 166/205; 166/105.1; 166/227; 166/233; 166/236

(58) Field of Classification Search
USPC ..... 166/205, 227, 233, 236, 265, 105, 166/105.1
See application file for complete search history.

(56) References Cited

U.S. PATENT DOCUMENTS

| | | | | |
|---|---|---|---|---|
| 4,148,735 | A * | 4/1979 | Laval, Jr. | 210/512.1 |
| 5,314,018 | A * | 5/1994 | Cobb | 166/265 |
| 5,516,360 | A | 5/1996 | Normandeau | |
| 5,730,871 | A | 3/1998 | Kennedy et al. | |
| 5,902,378 | A | 5/1999 | Obrejanu | |
| 6,017,456 | A | 1/2000 | Kennedy et al. | |
| 6,026,901 | A | 2/2000 | Brady et al. | |
| 6,036,749 | A | 3/2000 | Ribeiro et al. | |
| 6,070,661 | A | 6/2000 | Kennedy et al. | |
| 6,189,613 | B1 | 2/2001 | Chachula et al. | |
| 6,382,317 | B1 | 5/2002 | Cobb | |
| 6,394,183 | B1 | 5/2002 | Schrenkel et al. | |
| 6,619,390 | B1 | 9/2003 | Kellett, III | |
| 6,691,782 | B2 | 2/2004 | Vandevier | |
| 6,698,521 | B2 | 3/2004 | Schrenkel et al. | |
| 6,761,215 | B2 | 7/2004 | Morrison et al. | |
| 6,860,921 | B2 | 3/2005 | Hopper | |
| RE39,292 | E | 9/2006 | Latos et al. | |
| 7,241,104 | B2 | 7/2007 | Wilson et al. | |
| 7,244,282 | B2 | 7/2007 | Greif et al. | |
| 7,383,958 | B2 * | 6/2008 | Hemstock et al. | 210/519 |
| 7,695,548 | B1 | 4/2010 | Grubb et al. | |
| 7,695,549 | B2 | 4/2010 | Grubb et al. | |
| 7,909,092 | B2 | 3/2011 | Cobb | |
| 7,931,740 | B2 | 4/2011 | Al-Alusi et al. | |
| 7,938,203 | B1 | 5/2011 | Hall et al. | |
| 7,980,332 | B1 | 7/2011 | Hall et al. | |
| 7,984,772 | B1 | 7/2011 | Hall et al. | |
| 8,051,907 | B2 | 11/2011 | Cobb | |
| 2007/0295506 | A1 | 12/2007 | Li et al. | |
| 2009/0173545 | A1 | 7/2009 | Shotton | |
| 2012/0111578 | A1 | 5/2012 | Tverlid | |
| 2012/0217013 | A1 | 8/2012 | O'Malley | |
| 2013/0062066 | A1 * | 3/2013 | Broussard et al. | 166/305.1 |
| 2013/0319956 | A1 | 12/2013 | Tetzlaff | |
| 2013/0327002 | A1 | 12/2013 | Ackermann et al. | |

* cited by examiner

*Primary Examiner* — Kenneth L Thompson
*Assistant Examiner* — Taras P Bemko
(74) *Attorney, Agent, or Firm* — Buskop Law Group, PC; Wendy Buskop

(57) ABSTRACT

A desander system for a wellbore for separating wellbore fluid from particulate. The system having a dip tube nipple, a dip tube, base tubing connecting around the dip tube having base tubing perforations, two collars affixed to the base tubing, two weld rings affixed to the base tubing, a screen jacket mounted over the base tubing perforations, and a Venturi centrifugal helical desander having a Venturi tube with a bore connected to the base tubing. The Venturi tube having a plurality of spiral fins configured to flow particulate around the tube and a desander tube connected to the Venturi tube for flowing wellbore fluid over the outside of the Venturi tube causing a vortex while simultaneously allowing particulate to fall out while simultaneously allowing cleaned fluid to flow up the bore.

12 Claims, 3 Drawing Sheets

DESANDER SYSTEM

FIELD

The present embodiments generally relate to a desander for use in a producing hydrocarbon wellbore.

BACKGROUND

Production equipment failure happens when sand is pumped with the liquid to the surface, a distance of thousands of feet and then sand clogs either downhole or surface equipment. Heavier sand falls on top of downhole equipment causing sand cutting which causes pump failure, rod failure, tubing failure and short run life.

A need exists for an inline desander system that can remove particulates of multiple different diameters in multiple stages to insure improved equipment life and reduced failure of operation.

The present embodiments meet these needs.

BRIEF DESCRIPTION OF THE DRAWINGS

The detailed description will be better understood in conjunction with the accompanying drawings as follows.

Figure 1:
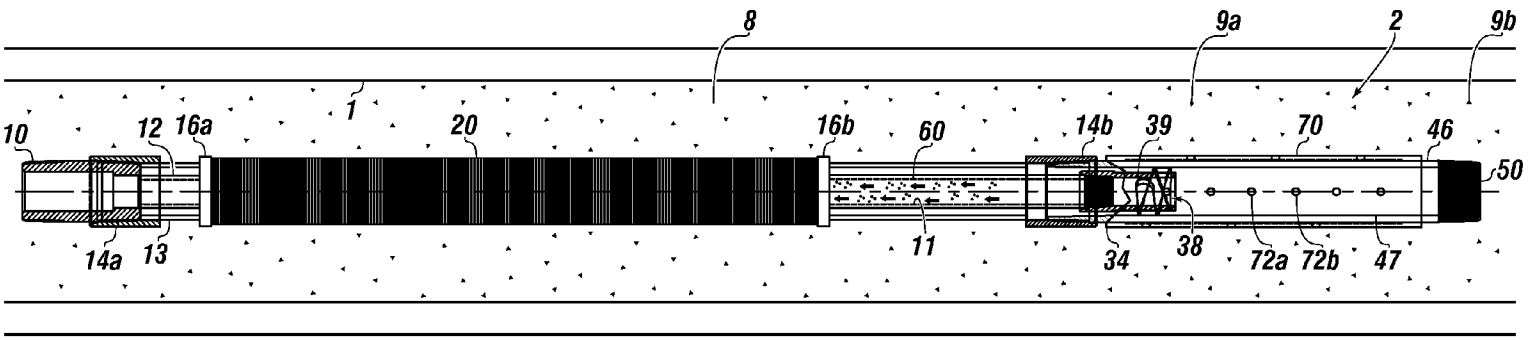
FIG. 1 is a side view of the desander system.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments relate to a desander system which attaches to downhole equipment and removes particulates in at least two steps producing a cleaned wellbore fluid.

The invention increases the efficiency of a well. The invention will save oil companies money by not having to pull equipment from the wellbore as often.

The invention should assist in increasing hydrocarbon production because the wellbore will keep producing without becoming clogged as often as current commercial devices. The invention increases a run time of the well.

The invention provides a desander system which reduces the possibility of total equipment shutdown when downhole production equipment becomes clogged with sand or other small particulate requiring a stuck pump pull that requires pulling of all rods and tubing together simultaneously from the wellbore, an expensive and dangerous activity.

The invention provides a reduction in the possibility of toxic spills caused when a producing well has downhole equipment that clogs and then malfunctions.

The desander system for a hydrocarbon wellbore can receive and separate wellbore fluid from particulates.

The desander system can include a dip tube nipple with a dip tube nipple annulus. A dip tube with an annulus can be connected to the dip tube nipple.

Base tubing can be connected around the dip tube. The base tubing can have a plurality of base tubing perforations through the walls of the base tubing, essentially forming a passage.

A first collar can be affixed, such as by welding, to the base tubing for engaging the dip tube nipple. A second collar can be affixed, such as by welding, to the base tubing on an opposite end of the base tubing from the first collar.

A first weld ring can be connected to the base tubing in a spaced apart relation to the first collar and can be configured to act as a first stop. A second weld ring can be connected to the base tubing in a spaced apart relation to the second collar and can be configured to act as a second stop.

A screen jacket can be mounted over the base tubing perforations between the first and second weld rings. The screen jacket can be created from a contiguous wrapped wire wrapped perpendicular to a longitudinal axis of the screen jacket.

The contiguous wrapped wire can form an inner surface and an outer surface. In embodiments, the contiguous wrapped wire can be a single wire.

The screen jacket can have a plurality of parallel mounted ribs mounted across the wrapped wire. Each rib can be mounted onto an inner surface of the screen jacket. Each rib is mounted in parallel to the longitudinal axis of the screen jacket.

In embodiments, the system can have a Venturi centrifugal helical desander. The Venturi centrifugal helical desander can have a Venturi tube with an outer tube surface and an inner wall, wherein the inner tube wall forms a bore.

The Venturi centrifugal helical desander can have a plurality of spiral fins configured to flow particulate around the Venturi tube.

The Venturi centrifugal helical desander can have a desander tube connected to the second collar. The desander tube can be configured to flow wellbore fluid over the outside of the Venturi tube causing a vortex, that is a spiraling, of wellbore fluid in the desander tube while simultaneously allowing particulates that have not been excluded by the screen jacket to pass to a desander tube inner wall to fall out a desander tube end while also simultaneously allowing cleaned fluid to flow up the bore of the Venturi tube to the annulus of the dip tube and to the dip tube nipple annulus.

A perforated sleeve can be mounted over the desander tube. The perforated sleeve can have a plurality of sleeve perforations for allowing wellbore fluid to collect between the desander tube and the perforated sleeve if the wellbore fluid cuts through the desander tube to kill the vortex. The perforated sleeve can effectively prevent the desander tube from being cut in half from particulates in the vortex. The spinning of the particulates in the vortex can cut the tube.

In embodiments, the perforated sleeve can have an outer diameter from 2 inches to 4.5 inches. In embodiments, the perforated sleeve can have a length from 10 inches to 20 inches. In embodiments, the perforated sleeve can have from 10 perforations to 40 sleeve perforations. In embodiments, each sleeve perforation can have a diameter from 0.25 inches to 0.5 inches.

In embodiments, the desander system for a wellbore can use a dip tube nipple with a threaded section on each end. The threads can be American Petroleum Institute coded EUE threads.

The dip tube nipple can be made from steel. The dip tube nipple can have a maximum length of 6 inches and be as short at 2 inches. In embodiments, the dip tube nipple can have a maximum outer diameter of 5 inches.

In embodiments, the dip tube can have an inner diameter from 1 inch to 1.5 inches. The dip tube can have an outer diameter from 1 and 5/16 inches to 3 inches. The dip tube can have a length from 4 feet to 25 feet. The dip tube can sustain a flow rate from 50 barrels per day to 2700 barrels per day.

In embodiments, the base tubing can be made from American Petroleum Institute steel standard J-55 standard steel. The base tubing can have a length from 40 inches to 24 feet.

The base tubing can have an inner diameter from 2 inches to 3 inches. The base tubing can have an outer diameter ranging from 2 and 3/8 inches to 3.5 inches.

In embodiments, the base tubing can have threads on each end to engage the collars. In other embodiments, the base tubing can be welded to the collars.

In embodiments, the base tubing can have from 1 perforation to 48 perforations per foot formed with equidistant spacing around the circumference of the base tubing. For example, when 48 perforations per foot are used, then it is expected that each perforation has a diameter of 3/8 of an inch.

In embodiments, the first collar can be affixed, such as by welding, to the base tubing for engaging the dip tube nipple. In embodiments, a second collar can be welded to the base tubing on an opposite end of the base tubing from the first collar.

The first and second collars can have identical construction in embodiments. In other embodiments the diameter of a first collar can be different from the diameter of the second collar.

In embodiments, the first and second collars can be configured with inner diameters that have a first smooth section, a helical threaded section and then a second smooth section. In other embodiments, the collars can have only one smooth section and a helical threaded section.

In embodiments, each collar can be a socket welded collar. In embodiments, the helical threaded section of each collar can range from 1.75 inches to 5 inches. In embodiments, the smooth unthreaded sections of each collar can each be from 1 inch to 4 inches long.

The collars can each have an inner diameter from 2 inches to 4 inches.

In embodiments, each weld ring can vary in inner diameter and outer diameter.

In embodiments, the each weld ring can have a length of from 0.25 inches to 0.75 inches, with an outer diameter from 2.5 inches to 4.5 inches. Each weld ring can be made from steel. Each weld ring can have an inner diameter from 2 inches to 4 inches.

In embodiments, the screen jacket can have a continuous contiguous wrapped wire made from stainless steel, such as 304 stainless steel or 316 stainless steel.

The wire of the screen jacket, in embodiments, is known as V wire. The V wire is named for its "V" shape.

In embodiments, the wire of the screen jacket has a thickness from 0.040 inches to 0.1 inch, and a height from 0.1 inch to 0.2 inches.

In embodiments, a length of the contiguous wire can be up to 300 feet long for a 20 foot long screen jacket. In other embodiments, a length of the contiguous wire can be as short as 32 feet for a 4 foot long screen jacket.

In embodiments, the each rib can extend a length ranging from 2 feet to 20 feet, so long as each rib extends the entire length of the inner surface of the screen jacket. There can be from 20 parallel mounted ribs to 40 parallel mounted ribs per screen jacket. In an embodiment, each rib can be equidistantly spaced apart from another rib and mounted around the inner surface of the screen jacket.

In embodiments, the Venturi centrifugal helical desander's Venturi tube can have a length from 4 inches to 6 inches. In embodiments, the Venturi tube can have an outer diameter from 1.5 inches to 3 inches and must be small enough to fit within the desander tube.

In embodiments, the Venturi tube can have a single spiral fin or a plurality of disconnected spiral fins wherein the plurality of disconnected fins and the single spiral fin can be configured to flow particulate around the tube. In embodiments, the plurality of disconnected fins can range from 2 to 6 fins mounted to the outer surface of the Venturi tube. The Venturi tube fins can cause a vortex of wellbore fluid.

To further understand the invention, the following connection procedure can be followed:

To connect the desander system to the production string of the wellbore, the dip tube nipple is screwed to a standard collar that is screwed to a seating nipple on the production string.

The bottom of the desander tube is screwed to the top of a mud joint downhole of the desander system.

To operate the desander system, once it is connected, wellbore fluid from the wellbore above the desander system is taken in through the screen jacket. The screen jacket filters out larger particulate from the wellbore and these larger particulates fall away from the screen jacket back into the wellbore. The fluid is partially cleaned by the screen jacket in this first stage cleaning. The wellbore fluid with remaining smaller particulate not excluded by the screen jacket and is flowed into the Venturi tube.

The Venturi tube performs a second stage cleaning of the wellbore fluid, by creating a vortex of the wellbore fluid and the vortex throws remaining small particulates in the wellbore fluid to the inner wall of the desander tube. The vortex of wellbore fluid is created when the wellbore fluid flows over the spiral fins on the outside of the Venturi tube.

The particulates fall out the end of the desander tube into the mud joint. The cleaned fluid flows up the bore of the Venturi tube to the annulus of the dip tube and to the dip tube nipple annulus finally to a pump mounted onto the seating nipple.

The desander system can treat from 50 barrels a day to 3500 barrels a day of wellbore fluid from a hydrocarbon well that is in production mode.

In embodiments, the cleaned fluid from the system can have 1 percent to 10 percent fine particulates still remaining in the cleaned fluid.

In an embodiment, the fine particulates can have a diameter from 0.002 inch to 0.006 inch.

Turning now to the Figures, FIG. 1 is a side view of the desander system with two stage separation.

The desander system 2 can include a dip tube nipple 10 which can engage a first collar 14*a*. The first collar can be affixed to the base tubing 13, such as with a weld.

The desander system can include a dip tube 12 with an annulus 11. The dip tube 12 can be fluidly connected to the dip tube nipple 10.

The base tubing 13 can be mounted around the dip tube 12. The base tubing 13 can have a plurality of base tubing perforations.

A second collar 14*b* can be affixed to the base tubing 13 on an opposite end of the base tubing from the first collar 14*a*.

A first weld ring 16*a* can be affixed to the base tubing 13 in a spaced apart relation from the first collar 14*a*.

The spaced apart distance from the first weld ring 16*a* to the first collar 14*a* can be from 1 inch to 26 inches. The first weld ring 16*a* can be configured to act as a first stop for a screen jacket 20 that provides the first stage of particulate separation.

A second weld ring 16*b* can be affixed to the base tubing 13 in a spaced apart relation to the second collar 14*b*. The second spaced apart distance between the second weld ring 16*b* and the second collar 14*b* can be from 1 inch to 36 inches. The second weld ring 16*b* can be configured to act as a second stop for the screen jacket 20 on an end opposite the first stop.

The screen jacket 20 can be mounted over the base tubing perforations between the first and second weld rings 16*a* and 16*b* to perform the first stage particulate separation.

Wellbore fluid 8 containing particulates 9*a* and 9*b* can flow from the wellbore 1 external of the screen jacket to the screen jacket 20. The screen jacket can exclude large particulates 9*a* but allow the wellbore fluid with smaller particulates 9*b* to penetrate through spaces in the screen jacket. The spaces in the screen jacket can vary from 0.008 inches to 0.075 inches.

The spaces in the screen jacket can be formed by using a contiguous wrapped wire, wherein the strands of the wire are spaced apart to make the screen jacket. The aforementioned spaces are created between wrappings of the wire. The wrapped wire can be supported by a plurality of parallel mounted ribs.

Wellbore fluid 8 with smaller particulate 9*b* can flow down through the second collar 14*b* into a Venturi centrifugal helical desander 34 and then to a desander tube 46 which has a desander tube end 50.

The Venturi tube, not shown in this Figure, can have an outer tube surface and an inner wall 39 forming a bore 38. Particulate can flow up and around a plurality of spiral fins creating a vortex. Particulate 9*b* can be allowed drop out of the desander tube end 50 of the desander system 2.

A perforated sleeve 70 can be mounted over the desander tube 46. The perforated sleeve 70 can have a plurality of sleeve perforations 72*a* and 72*b*.

The sleeve perforations can allow wellbore fluid 8 with particulate that has not been excluded out by the screen jacket in a second stage separation to flow over the outside of the Venturi tube causing a vortex of wellbore fluid in the desander tube while simultaneously allowing particulate that has not been filtered out by the screen jacket to pass to the desander tube inner wall 47 to fall out the desander tube end 50 while simultaneously allowing cleaned fluid 60 to flow up the bore to the annulus 11.

Figure 2:
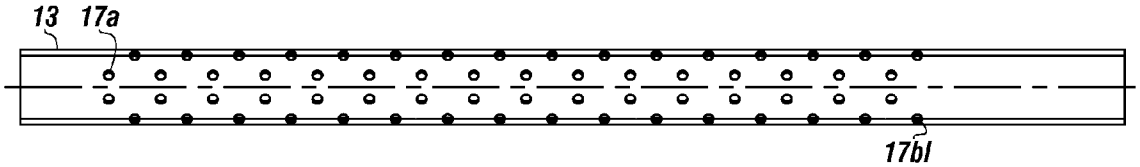
FIG. 2 is a detail of the base tubing with perforations used in the desander system.

FIG. 2 depicts a detail of the base tubing 13 with perforations 17*a*-17*b*1 used in the desander system. In this embodiment, the perforations are shown distanced from the ends of the base tubing. The perforations can be from 1 inch to 36 inches from the end of the screen jacket. In embodiments, the perforations can cover from 60 percent to 80 percent of the base tubing.

Figure 4:
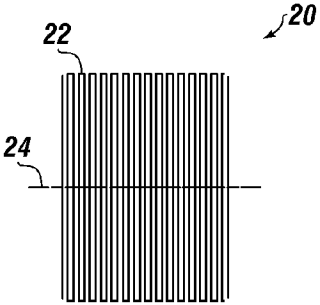
FIG. 4 is side view of the screen jacket usable in the desander system.
Figure 3:
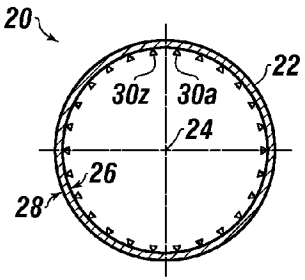
FIG. 3 is a cross sectional view of a screen jacket usable in the desander system.

FIG. 3 is a cross sectional view of a screen jacket usable in the desander system. FIG. 4 is side view of the screen jacket usable in the desander system.

Referring to FIGS. 3 and 4, the screen jacket 20 can have a length from 36 inches to 20 feet.

The screen jacket 20 can be made from a contiguous wrapped wire 22. The contiguous wrapped wire 22 can be wrapped perpendicular to a longitudinal axis 24 of the screen jacket 20.

The contiguous wrapped wire can form an inner surface 26 and an outer surface 28.

A plurality of parallel mounted ribs 30*a*-30*z* can be mounted to the inner surface 26 of the screen jacket 20. The plurality of parallel mounted ribs can be mounted in parallel to the longitudinal axis 24 of the screen jacket.

Figure 5:
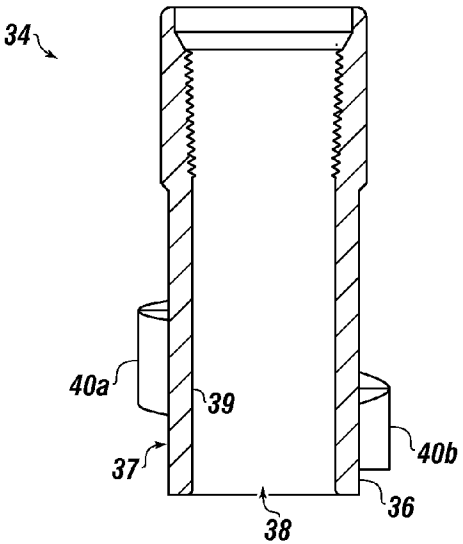
FIG. 5 is a cross sectional view of a Venturi centrifugal helical desander usable in the desander system.

FIG. 5 is a cross sectional view of the Venturi centrifugal helical desander 34 usable in the desander system.

The Venturi centrifugal helical desander 34 can have a Venturi tube 36 with a bore 38. The Venturi tube 36 can have an outer tube surface 37 and an inner wall 39.

A plurality of spiral fins 40*a* and 40*b* can be mounted to the outer tube surface 37. The spiral fins can cause a vortex of wellbore fluid to increase in velocity. The rate of acceleration of the wellbore fluid is dependent on the angle and number of the spiral fins. The spiral fins can be configured to flow wellbore fluid with small particulate not excluded by the screen jacket around the Venturi tube 36.

Figure 6:
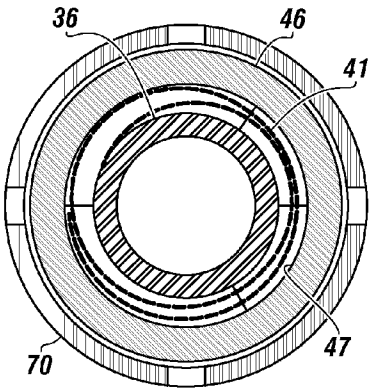
FIG. 6 is an end view of the desander tube covered by a perforated sleeve.

FIG. 6 is an end view of the perforated sleeve 70 around desander tube 46. The desander tube 46 can be connected to the second collar.

Each spiral fin can touch a desander tube inner wall 47 or be in close proximity to the desander tube inner wall.

The desander tube 46 can be configured to flow wellbore fluid containing particulate that has not been excluded out by the screen jacket in a second stage separation over the outside of the Venturi tube 36 causing a vortex 41 of wellbore fluid in the desander tube while simultaneously allowing particulate that has not been filtered out by the screen jacket to pass to the desander tube inner wall 47 to fall out a desander tube end while simultaneously allowing cleaned fluid to flow up the bore to the annulus.

The screen jacket does not cover the desander tube.

Figure 7:
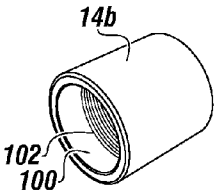
FIG. 7 is a perspective view of the inside of a usable collar.

FIG. 7 is a perspective view of the inside of a usable collar, shown as second collar 14*b* with a first smooth inner section 100 and a threaded section 102 adjacent the first smooth inner section. In embodiments, a second smooth inner section can be formed adjacent the threaded section.

Figure 8:
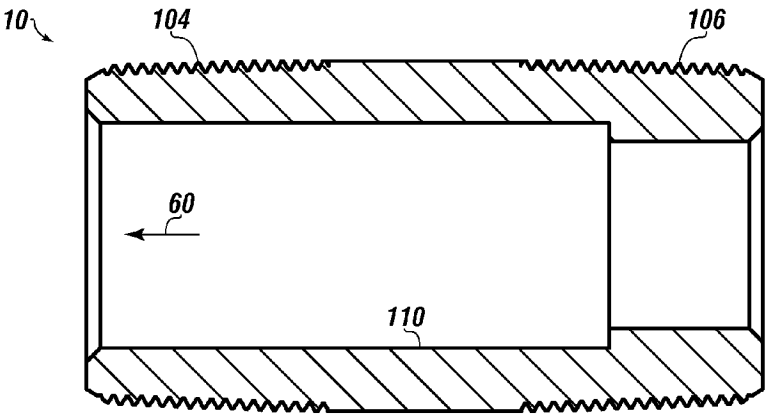
FIG. 8 is a view of a dip tube nipple with a threaded section.

FIG. 8 is a view of a dip tube nipple 10 with two threaded sections 104 and 106 on each end of the dip tube. The dip tube nipple 10 can have a dip tube nipple annulus 110 for flowing cleaned fluid 60 from the dip tube.

While these embodiments have been described with emphasis on the embodiments, it should be understood that within the scope of the appended claims, the embodiments might be practiced other than as specifically described herein.

What is claimed is:

1. A desander system for a wellbore for receiving and separating wellbore fluid from particulate in a two stage separation, the desander system comprising:

a. a dip tube nipple;

b. a dip tube with an annulus connected to the dip tube nipple;

c. base tubing connecting around the dip tube having a plurality of base tubing perforations;

d. a first collar affixed to the base tubing for engaging the dip tube nipple;

e. a second collar affixed to the base tubing on an opposite end of the base tubing from the first collar;

f. a first weld ring affixed to the base tubing in a spaced apart relation to the first collar, the first weld ring configured to act as a first stop;

g. a second weld ring affixed to the base tubing in a spaced apart relation to the second collar, the second weld ring configured to act as a second stop;

h. a screen jacket mounted over the base tubing perforations between the first weld ring and the second weld ring to provide a first stage particulate separation, the screen jacket comprising:

(i) a contiguous wrapped wire wrapped perpendicular to a longitudinal axis of the screen jacket forming an inner surface and an outer surface; and (ii) a plurality of parallel mounted ribs, each parallel mounted rib mounted onto the inner surface and mounted in parallel to the longitudinal axis;

i. a venturi centrifugal helical desander comprising:

(i) a venturi tube with an outer tube surface and an inner wall forming a bore; and (ii) a plurality of spiral fins mounted to the outer tube surface of the venturi tube and configured to flow wellbore fluid with particulate that has not been filtered out by the screen jacket to flow around the venturi tube; and (iii) a desander tube connected to the second collar, wherein each spiral fin touches a desander tube inner wall, wherein the desander tube is configured to flow wellbore fluid containing particulate that has not been excluded out by the screen jacket in a second stage particulate separation over the outside of the venturi tube causing a vortex of wellbore fluid in the desander tube while simultaneously allowing particulate that has not been filtered out by the screen jacket to pass to the desander tube inner wall to fall out a desander tube end while simultaneously allowing cleaned fluid to flow up the bore to the annulus; and j. a perforated sleeve mounted over the desander tube, the perforated sleeve comprising a plurality of sleeve perforations, wherein the perforated sleeve allows the wellbore fluid to collect between the desander tube and the perforated sleeve allowing the wellbore fluid to be in fluid communication between the bore and the wellbore to kill the vortex if the vortex cuts through the desander tube.

2. The desander system for a wellbore of claim 1, wherein the screen jacket comprises a V shaped wire.

3. The desander system for a wellbore of claim 1, wherein the dip tube nipple has a threaded section on each end.

4. The desander system for a wellbore of claim 1, wherein the base tubing has from 1 perforation to 48 perforations per foot formed with equidistance spacing around the base tubing.

5. The desander system for a wellbore of claim 1, wherein the venturi tube has a length from 4 inches to 6 inches.

6. The desander system for a wellbore of claim 1, wherein the venturi tube has a single spiral fin or a plurality of disconnected spiral fins configured to flow particulate around the venturi tube.

7. The desander system for a wellbore of claim 6, wherein the plurality of disconnected fins range from 2 fins to 6 fins mounted to the outer surface of the venturi tube.

8. The desander system for a wellbore of claim 1, wherein the plurality of spiral fins causing the vortex of wellbore fluid increase the velocity of the wellbore fluid wherein the rate of acceleration of the wellbore fluid is dependent on the angle and number of the spiral fins.

9. The desander system for a wellbore of claim 1, wherein the cleaned fluid has from 1 percent to 10 percent fine particulate still remaining in the cleaned fluid, wherein the fine particulate has a diameter from 0.002 inches to 0.006 inches.

10. The desander system for a wellbore of claim 1, wherein the perforated sleeve has a length from 10 inches to 20 inches.

11. The desander system for a wellbore of claim 1, wherein the perforated sleeve has from 10 perforations to 40 perforations.

12. The desander system for a wellbore of claim 1, wherein the screen jacket has a length from 36 inches to 20 feet.

* * * * *